US006601526B2

(12) United States Patent
Gutmark et al.

(10) Patent No.: US 6,601,526 B2
(45) Date of Patent: Aug. 5, 2003

(54) COMPACT DUAL CYCLONE COMBUSTOR

(75) Inventors: Ephraim J. Gutmark, Cincinnati, OH (US); Alyson K. Hubbs, Zachary, LA (US); Roberto Jimenez; Gary J. Leonards, both of Baton Rouge, LA (US)

(73) Assignee: Board of Supervisors of Louisiana State University and Agricultural and Mechanical College, Baton Rouge, LA (US)

( * ) Notice: Subject to any disclaimer, the term of this patent is extended or adjusted under 35 U.S.C. 154(b) by 0 days.

(21) Appl. No.: 09/757,149

(22) Filed: Jan. 9, 2001

(65) Prior Publication Data

US 2002/0092449 A1 Jul. 18, 2002

(51) Int. Cl.[7] ..... F23G 5/00; F23C 9/00

(52) U.S. Cl. ..... 110/346; 110/347; 110/213; 110/214; 110/244; 110/248; 110/295

(58) Field of Search ..... 110/210, 213, 110/214, 243, 244, 245, 248, 251, 252, 295, 346, 347, 101 R; 431/173; 126/73, 74, 75, 76

(56) References Cited

U.S. PATENT DOCUMENTS

| | | | | | |
|---|---|---|---|---|---|
| 105,587 | A | * | 7/1870 | Meissner | 126/73 |
| 112,936 | A | * | 3/1871 | Litchfield | 126/73 |
| 694,712 | A | * | 3/1902 | Atteberry | 126/73 |
| 1,160,437 | A | * | 11/1915 | Myers | 126/73 |
| 2,707,444 | A | | 5/1955 | Van Loon | 110/28 |
| 3,457,883 | A | * | 7/1969 | Ankersen | 110/10 |
| 3,658,017 | A | * | 4/1972 | Dibelius | 110/8 R |
| 3,777,678 | A | | 12/1973 | Lutes et al. | 110/8 R |
| 3,855,951 | A | | 12/1974 | Giles | 110/8 R |
| 3,858,534 | A | * | 1/1975 | Berg | 110/8 R |
| 4,144,019 | A | | 3/1979 | Lyshkow v | 431/173 |
| 4,261,269 | A | * | 4/1981 | Mallek et al. | 110/251 |
| 4,502,464 | A | * | 3/1985 | Figueroa | 126/163 R |
| 4,548,138 | A | * | 10/1985 | Korenberg | 110/245 |
| 4,565,137 | A | | 1/1986 | Wright | 110/264 |
| 5,111,757 | A | | 5/1992 | Reindl et al. | 110/264 |

(List continued on next page.)

OTHER PUBLICATIONS

Beenackers, A. et al. ed., "Advanced Gasification: Methanol Production from Wood—Results of the EEC Pilot Programme," Kluwer Academic, pp. 36–45 (1986).

Bertges, A. et al., Acoustically Excited Vortex Incinerator for Biological Materials, unpublished written presentation, on file with the Louisiana State University Department of Biological Engineering (Apr. 30, 1997).

Fox, R. et al., *Introduction to Fluid Mechanics*, John Wiley & Sons, 4th ed., pp. 443–446 (1992).

(List continued on next page.)

*Primary Examiner*—Ira S. Lazarus
*Assistant Examiner*—K. B. Rinehart
(74) *Attorney, Agent, or Firm*—André J. Porter; Bonnie J. Davis; John H. Runnels

(57) ABSTRACT

An apparatus and method of creating a high combustion rate in a combustor used to burn combustible matter. The combustor comprising a cylindrical combustion chamber extending vertically with at least one side loading bin for loading combustible matter into the combustion chamber while combustion is ongoing. The combustor creates a high combustion rate by inducing an acoustic excitation and an ascending vortex in hot gases that is reflected by a conical surface, converting the ascending vortex to a descending vortex. The shear between the ascending and descending vortices increases mixing. The descending vortex acts to separate the small, fully-combusted particles from larger particles that are thrown by centrifugal force back into the combustion zone.

10 Claims, 5 Drawing Sheets

U.S. PATENT DOCUMENTS

| | | | | | |
|---|---|---|---|---|---|
| 5,123,361 | A | | 6/1992 | Nieh et al. | 110/264 |
| 5,193,490 | A | | 3/1993 | Peruski | 122/4 D |
| 5,316,735 | A | * | 5/1994 | Ivanov et al. | 422/143 |
| 5,361,710 | A | | 11/1994 | Gutmark et al. | 110/346 |
| 5,415,113 | A | | 5/1995 | Wheeler et al. | 110/241 |
| 5,558,028 | A | * | 9/1996 | Lin | 110/243 |
| 5,944,512 | A | * | 8/1999 | Ludwig | 432/72 |
| 6,161,490 | A | * | 12/2000 | Fujinami et al. | 110/346 |
| 6,216,610 | B1 | * | 4/2001 | Brunnmair et al. | 110/213 |

OTHER PUBLICATIONS

Gutmark et al., "Structure of a Controlled Ducted Flame," Combustion Science and Technology, vol. 87, pp. 217–239 (1992).

Henderson, S. et al., *Agricultural Process Engineering*, John Wiley & Sons, Inc., pp. 170–177 (1955).

Jackson, T. et al., "The Role of Acoustics in Flame/Vortex Interactions," Journal of Fluid Mechanics, vol. 254, pp. 579–603 (1993).

Lee, C. et al., "Incinerability Ranking Systems for RCRA Hazardous Constituents," Hazardous Waste and Hazardous Materials, vol. 7, No. 4, pp. 385–415 (1990).

Liou, T. et al., "Self–Sustained Flow Oscillation in a Ducted Combuster with Multiple Inlets," AIAA Journal, vol. 33, No. 8, pp. 1412–1417 (1995).

Niessen, W., *Combustion and Incineration Processes*, Marcel Dekker, Inc., New York, pp. 1–4 (1978).

Seeker, R., "Wasste Combustion," Twenty–Third Symposium (International) on Combustion, The Combustion Institute, pp. 867–885 (1990).

Willis, J. et al., "Acoustic Alteration in a Dump Combustor Arising From Halon Addition," Combustion and Science Technology, vol. 94, pp. 469–481 (1993).

Willis, J. et al., "Destruction of Liquid and Gaseous Waste Surrogates in an Acoustically Excited Dump Combustor," Combustion and Flame, vol. 99, pp. 280–287 (1994).

Zabrodsky, S., *Hydrodynamics and Heat Transfer in Fluidized Beds*, The M.I.T. Press, pp. 138–140 (1966).

Bae News, p. 3 (Louisiana State University, Baton Rouge, LA), May 1997.

* cited by examiner

COMPACT DUAL CYCLONE COMBUSTOR

This invention pertains to a combustor designed to provide a non-toxic method of completely combusting organic or inorganic materials by using a dual cyclone to recirculate particulate matter.

The disposal of waste vegetation (i.e., trees, brush, yard waste, etc.) and other organic materials is a major concern of municipal, commercial, and private sectors. Various techniques are currently used to dispose of such waste. The most common technique has been burying waste in landfill sites. However, landfill sites are becoming scarce and cost-prohibitive due to rapidly expanding urban areas. See U.S. Pat. No. 5,415,113.

One alternative to landfills is incineration. An incinerator is a device that uses high temperature combustion to produce relatively complete oxidation of the waste material. The efficiency of combustion can be increased by maximizing mixing. Mixing has important effects on heat and mass transfer and on chemical reactions. See S. Zabrodsky, *Hydrodynamics and Heat Transfer in Fluidized Beds*, (M.I.T. Press, Cambridge, 1966). Incineration (combustion) is one of the most widely used treatments of hazardous waste, offering the following advantages: (1) volume reduction, (2) detoxification, (3) environmental impact mitigation, (4) regulatory compliance, and (5) energy recovery. See W. Niessen, *Combustion and Incineration Processes*, (Marcel Dekker, Inc., New York, 1978). Additionally, incineration of waste vegetation produces an ash residue high in natural nutrients that are beneficial to plant growth. When the ash is mixed with compost and varying amounts of soil, a range of products including high-grade potting soil and top soil can be produced.

As compared to other waste treatment methods, incineration achieves the highest overall destruction and control for the broadest range of waste streams. Therefore, incineration is gradually replacing the disposal of wastes in landfills. See C. Lee et al., "Incinerability Ranking Systems for RCRA Hazardous Constituents," *Hazardous Waste and Hazardous Materials*, vol. 7, no. 4, pp. 385–415 (1990). The environmental hazards of burning trash in barrels or other types of open burning are not present with proper incineration. Unlike backyard open fires, which burn in the range of 200–300° C., resulting in incomplete combustion, municipal waste incinerators burn at temperatures over 1000° C. and add enough oxygen to achieve essentially complete combustion. Many dangerous compounds can be completely eliminated at these high temperatures, while eliminating smoke and odor. See Lee et al., 1990.

The primary objective of waste combustion is to destroy the organic and pathogenic constituents in the waste streams, leaving behind an inert residue with minimum carbon content. To be a successful waste management option, combustion must accomplish this goal in a cost-effective and fuel-efficient manner, without creating significant risks from emissions. See R. Seeker, "Waste Combustion," Twenty-third Symposium on Combustion/The Combustion Institute, pp. 867–885 (1990).

The simplest definition of combustible waste is material that has primarily an organic content and that can be oxidized by combustion. Three features of the waste generally determine the combustion characteristics and type of equipment that is suitable. These include the average physical and chemical characteristics of the waste, any special constituents in the waste streams, and the variability of the waste properties.

Several parameters have been found to increase combustion efficiency, including high temperature and excitation of particles by acoustic vibrations. See Seeker, 1990; I. Glassman, "Combustion," Academic Press, 2$^{nd}$ ed., pp. 386–409 (1987); and J. Willis et al., "Acoustic Alteration in a Dump Combustor Arising From Halon Addition," Combustion and Science and Technology, vol. 94, pp. 469–481 (1993). Another important factor in efficient combustion is recirculation of incompletely burned particles. One way to increase recirculation is to use a cyclone separator. Cyclone separation occurs when air and waste enter tangentially at the top of the tube and descend with a generally circular motion described by an outer vortex. During the downward descent, the heavier material travels along the periphery of the tube and is thus separated from the lighter "clean air." See S. Henderson et al., *Agricultural Process Engineering*, (John Wiley and Sons, Inc., New York, 1955).

Combustion is a complicated process. A complete analytical description of a combustion system requires consideration of the following factors, among others: (1) chemical reaction kinetics and thermodynamics under nonisothermal, heterogeneous, and nonsteady conditions; (2) fluid mechanics in nonisothermal, heterogeneous, reacting mixtures, with heat release that can involve laminar, transition, turbulent, plug, recirculating, and swirling flows within geometrically complex enclosures; and (3) heat transfer by conduction, convection, and radiation between gases, liquids, and solids with high heat release rates and (with boiler systems) high withdrawal rates.

One important physical parameter in waste incinerator design and operation is the character of the waste feed. Waste materials can include a wide spectrum of physical forms, e.g., pumpable liquids, sludge, slurries, tarry semi-solids, contaminated soils, solid refuse (paper, plastic), and bulky solids. The physical characteristics largely dictate the method used to introduce the waste into the device and the combustion chamber configuration employed. See Seeker, 1990.

Another key parameter that dictates the design and operation of combustion systems for a particular form of waste is the presence of any special constituents that can influence system operation or performance, e.g., lead to pollution formation, retard the flame, form fine salt particles, or cause corrosion.

When combusting organic materials such as wood, several factors must be considered, including the "global" molecular formula, the low heat value in the dry-ash-free state, and the heat of formation. The "global" molecular formula of wood is about $C_6H_9O_4$. In the dry-ash-free state, the heat value ranges between 4200 and 4500 kcal/kg, depending on the wood species. A standard heat of formation for wood is −188 kcal/mol at 25° C. Wood that has been naturally dried in ambient air stabilizes its moisture content at about 20 percent. As wood is heated, it first gives off primarily water vapor. When temperatures reach about 275° C. or above, fuel gases are produced that spontaneously burn in air between 450 and 650° C., a process called pyrolysis. After pyrolysis, the residual carbon remaining (probably due to an insufficient amount of oxygen) represents about 15 to 30 weight percent of the initial wood. The rate of the thermal degradation, as well as the nature and quantities of the various products, depend on the temperature. The overall kinetics depend on the size of the wood particles. See A. Beenackers, *Advanced Gasification*, (Kluwer Academic, Massachusetts, 1986).

Stoichiometric combustion of typical wood is described by the following reaction:

$$C_6H_9O_4+6.25O_2 \rightarrow 6CO_2+4.5H_2O$$

Temperature, one of the most important parameters in combustion processes, is difficult to measure and control.

Temperature variability inside an incinerator is caused by many factors, including wall radiation, flow velocity, and oxidation reactions on wall surfaces.

The presence of sound waves in a dump combustion chamber has been shown to increase the rate at which particles decompose. The acoustic vibrations cause a higher rate of mixing of particles and oxygen, producing a reduced combustion time. See J. Willis et al., "Destruction of Liquid and Gaseous Waste Surrogates in an Acoustically Excited Dump Combustor," Combustion and Flame, vol. 99, pp. 280–287 (1994).

It has also been determined that resonant acoustic conditions in dump combustors can materially increase the rate of heat release, resulting in high volumetric heat release rates, i.e., high power in a compact device. Under resonant conditions, chemistry, fluid mechanics, and acoustics are tightly coupled. Thus, an incinerator that takes full advantage of resonant operation must be designed to handle changes in heat release rates or characteristic chemical reaction times. See Willis et al., 1994.

In prior studies, three different acoustic modes were identified with combustion operation, including frequencies in the 600–700 Hz range, the 400–600 Hz range, and the 30–50 Hz range. See Willis et al., 1994. The level of waste destruction can be strongly influenced by the acoustic mode. For example, operation in the lowest frequency mode results in levels of destruction two orders of magnitude lower than that observed in high frequency modes. See Willis et al., 1994.

U.S. Pat. No. 5,944,512 describes an incineration device for use in heating applications in which the process stream is re-circulated. The device comprises a tangential blower inlet, a single exhaust outlet at the top, and a vertical, conical-shaped heating chamber where the apex of the cone is near the flame at the bottom.

U.S. Pat. No. 5,415,113 describes a portable incineration device for disposing waste vegetation, comprising a box-shaped combustion chamber and a manifold assembly adapted to direct a curtain of high velocity air across the top opening of the combustion chamber. The high velocity air is directed down into the combustion chamber and then exits at the top.

U.S. Pat. No. 5,361,710 describes a compact waste incinerator that improves combustion efficiency through the active production, placement, and stabilization of large scale vortices within the combustion chamber, coupled with the controlled and synchronized injection of fuel and waste relative to the large scale vortices.

U.S. Pat. No. 5,193,490 describes a circulating fluidized bed boiler that uses a horizontal, cylindrical-shaped chamber with multiple inlets to induce cyclonic mixing and combustion.

U.S. Pat. No. 5,123,361 describes an annular vortex combustor that burns highly viscous fuel, for example, ultra-fine coal, pulverized coal, or coal water fuel. A vertically oriented vortex is created when fuel and atomizing air are injected tangentially near the bottom of combustion chamber. The vortex motion is maintained by injecting secondary air through nozzles vertically distributed along the length of the combustion chamber.

U.S. Pat. No. 5,111,757 describes a cylindrical containment vessel that is defined by stable fluid recirculation, maintained by the superposition of at least two vortices produced by a combination of nozzles and blowers.

U.S. Pat. No. 4,565,137 describes a solid bio-mass fuel burner with a specialized delivery system for injecting solid fuel into a combustor involving multiple air injectors that help create a cyclonic vortex. The vortex is maintained by tangentially injecting air into the combustion chamber through a plurality of passages horizontally distributed along the longitudinal axis of the chamber.

U.S. Pat. No. 4,144,019 describes a double vortex, horizontal burner that comprises both a cylindrical outer chamber and a cylindrical inner wall that terminates at a cone-shaped end. Walls separate the two vortices.

U.S. Pat. No. 3,855,951 describes a cyclonic incinerator that combines a vertically oriented cyclone separator, a combustion chamber with an inclined or conical kiln device, and a recirculation flow line for greater combustion and particulate removal efficiency.

U.S. Pat. No. 3,777,678 describes a fuel burner having a horizontally oriented circular chamber into which air and fuel are tangentially injected, creating a cyclone movement that is maintained by injecting air through a plurality of openings along the length of the chamber.

U.S. Pat. No. 2,707,444 describes a cyclonic furnace that creates a cyclonic vortex by injecting entrained fuel and air through one or more tangential inlets located near the top of the chamber. Small combusted particulates exit an axial outlet at the top of the chamber.

We have discovered an induced-vortex combustor that provides a method to combust organic or inorganic materials. The device comprises a vertical combustion chamber with a conical top and an air exhaust that exits through the bottom. The initial fuel rests on a conical mesh just above the burner. Air flows into the chamber below the screen to suspend the materials as it burns. The device also allows loading of material during combustion through two loading bins, whereas other combustors must be shut down to add additional material. Optionally, acoustical devices can be added to aid mixing.

Unlike prior incinerators or solid fuel combustors that rely on secondary air to maintain a vortex, the novel device creates a vortex system comprising two vortices that increase mixing of material through the continuous injection of air tangentially near the base of the combustion chamber and increase the combustion of particles through recirculation. The initial injection of air creates a horizontal, outer ascending vortex that is converted to a descending, inner vortex by the conical top, resulting in a double vortex system.

The novel combustor combusts essentially all of the deposited materials, fuel, and oxygen, by inducing a double vortex, which facilitates a high mixing and separation rate of particles. Additionally, the combustor allows an operator to add material to the combustion chamber while the system is operating. The device may also be used as an efficient heat exchanger. Any combustible material, either inorganic or organic, can be burned using this novel combustor.

In a preferred embodiment, the combustor comprises a cylindrical chamber extending vertically with two side loading bins attached to opposite sides of the chamber. The side loading bins, each with two doors, create trapped spaces allowing material to be loaded first into a bin and then into the chamber without having to shut down the combustor. Upon loading the bins, the materials slide down an angled wall until making contact with the second door. The second door is manually controlled externally to allow an operator to repeatedly load the combustion chamber.

To facilitate efficient combustion, a volatile pilot fuel, Such as propane gas, is piped into the base of the combustion chamber and ignited. For organic dry material, the pilot fuel can be discontinued once combustion temperature reaches a level that is self-sustaining. Optionally, the device may have a resonance generator, for example, one or more speakers mounted to the exterior wall of the combustion chamber near its base and capable of withstanding temperatures up to 850° C., such as Sanming model S-75A loudspeakers (Sanming Electronics, Inc., China). The speakers produce acoustic vibrations by emitting frequency tones that increase mixing of particles and oxygen, thus reducing the combustion time.

Figure 1:
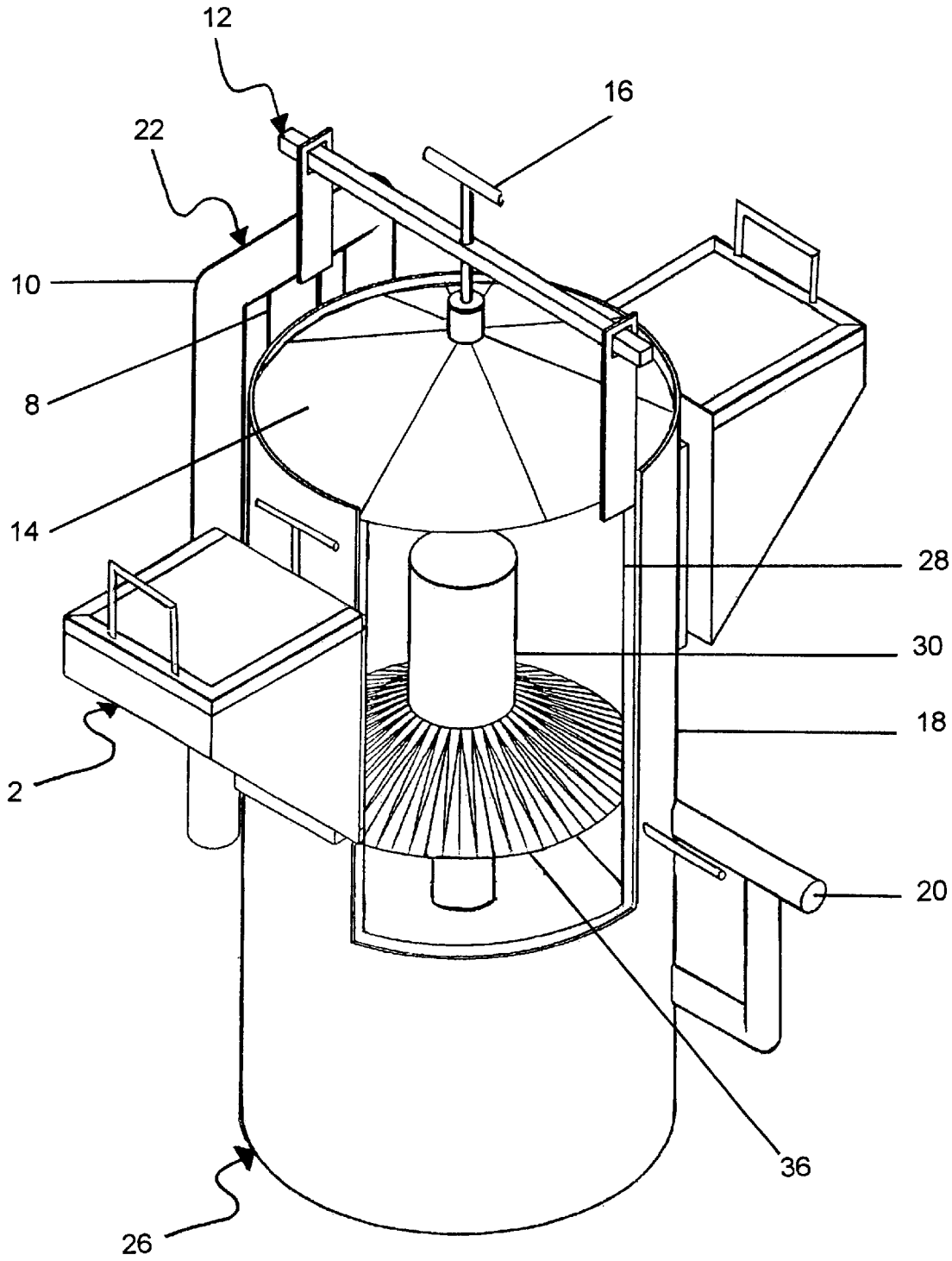
FIG. 1 illustrates a cutaway, perspective view of one embodiment of the vortex combustor.

FIG. 1 illustrates one embodiment of a combustor 26 in accordance with the present invention. This embodiment comprises a cylindrical combustion chamber 18, side loading bins 2, and an exhaust system 22. Optionally, an acoustic resonance generator can be added, comprising a plurality of loudspeakers attached to a pipe which extends from the inside of the combustion chamber 18 to a point outside of the combustion chamber 18.

In the embodiment illustrated in FIG. 1, air entered the combustion chamber 18 tangentially through the air inlet 20, located near the base of the chamber 18. The flow of air was sufficient to create a flame vortex as it passed through the burner assembly 24. (See FIG. 3) The burner assembly 24 was located near the base of the combustion chamber 18.

The combustor included a removable stainless steel, conically shaped lid 14 held by lid support assembly 12. The lid 14 should be tight to prevent hot air and debris from escaping. The lid 14 can be removed by rotating the lid support handle 16. Removal of the lid 14 allows the operator access to the inner combustion chamber 18. Optionally, a side panel can be added to the combustor that would allow the operator to access the inner combustion chamber 18.

The internal surfaces of the combustor 26 were insulated from heat by a refractory material 28 capable of withstanding temperatures up to 1000° C., such as RESCOCAST® 3-20R (Resco Products Incorporated, Norristown, Pa.). In a preferred embodiment, all parts of the device that contact heated materials would be insulated with refractory material. The top portion of refractory material 28 can be encased by an iron ring to prevent refractory material 28 from chipping away when the conical lid 14 is engaged.

Figure 2B:
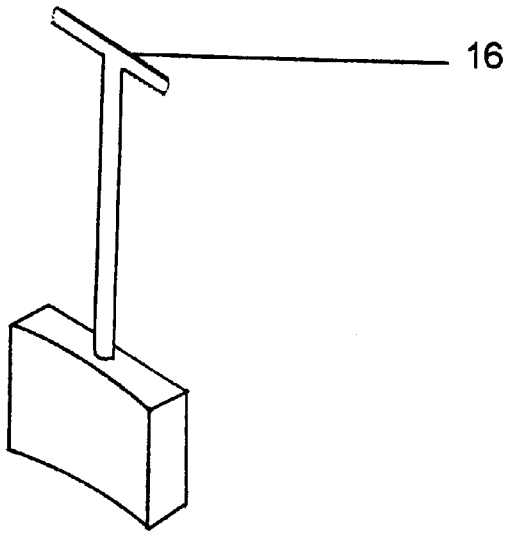
FIG. 2*b* illustrates a perspective view of a slide door of one embodiment of a loading bin.
Figure 2A:
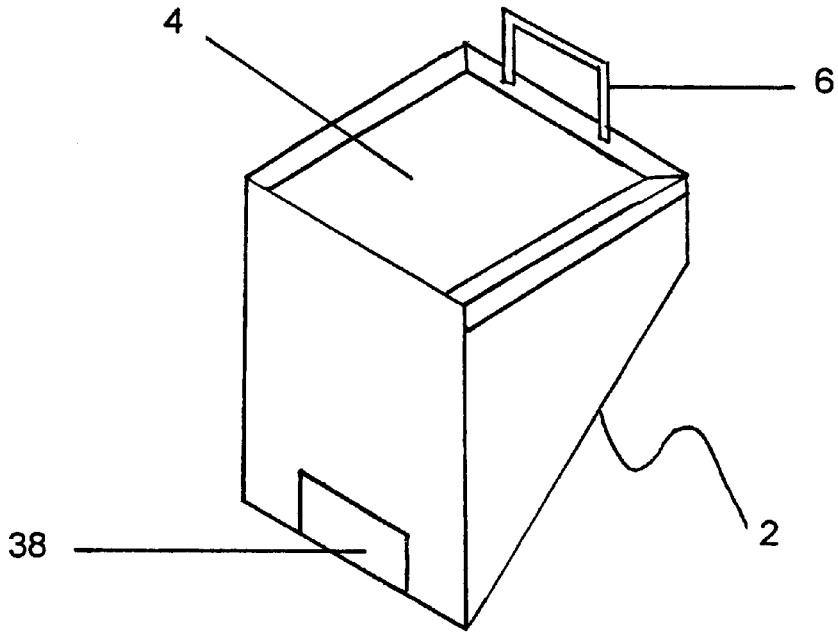
FIG. 2*a* illustrates a perspective view of one embodiment of a loading bin.

FIGS. 2*a* and 2*b* illustrate exploded perspective views of one embodiment of the loading bins 2 and of a sliding door handle 16, respectively. FIG. 2*a* illustrates the loading bin 2 in which combustible material (organic or inorganic) was deposited by lifting the bin flip cover 4 with handle 6. FIG. 2*b* illustrates the slide door handle 16 which, when raised, allowed the loaded material to enter chamber 18 through bin exit 38.

Figure 3:
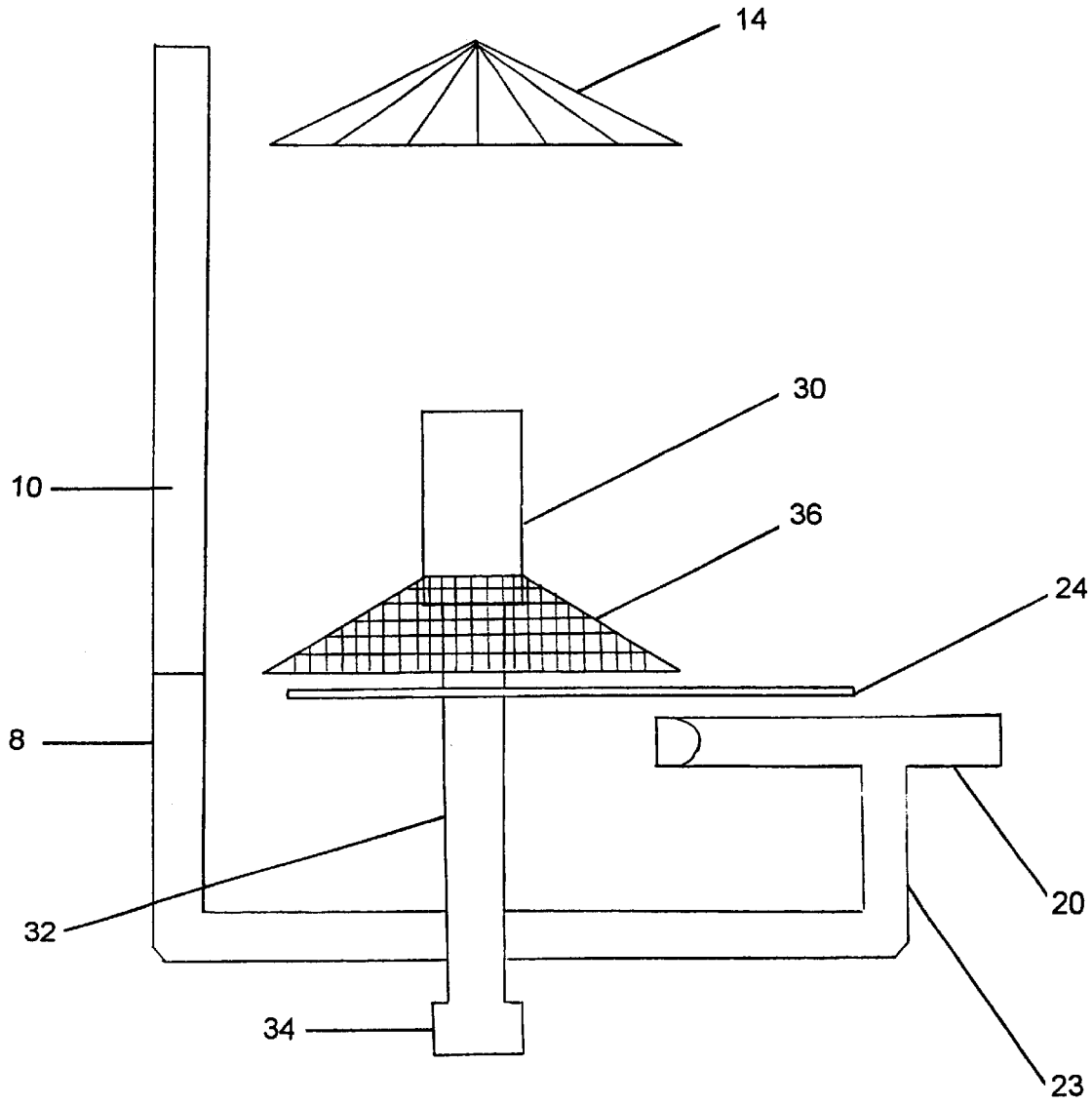
FIG. 3 illustrates a schematic view of some of the parts of one embodiment of the combustor.

FIG. 3 illustrates a schematic view of some of the components of the combustor 26. To facilitate the heating and combustion process, the burner assembly pipe 24 had holes longitudinally displaced and oriented facing upwards. The free end of the burner pipe 24 was connected to an external fuel source, such as a propane tank. Air tangentially entered the chamber through the air inlet 20 and passed under the flame produced by the burner assembly 24, creating a flame vortex ascending towards the lid 14 along the outer wall. As the vortex reached the lid 14, it was reflected forming a second, descending vortex. As the descending vortex traveled towards mesh 36, combustion particulates entered a separator 30 that was suspended upward from the base of the chamber 18. In a preferred embodiment, the mesh 36 had a steep slope to assist in circulating material. The inner diameter of the separator 30 was relatively large, so that the centrifugal action of the descending vortex forced large particles outward for further combusting, while small combusted particles remained near the center of the vortex and entered the exit pipe 32 in the center of the separator 30. The separator 30 was suspended by arms that extended radially from the top of exit pipe 32. (not shown) A cone-shaped bottom plate could be added at the base of the chamber 18 to direct ash to the outer edge of the chamber 18 for better recirculation.

In a preferred embodiment, illustrated in FIG. 3, the small combustion particulates that entered exit pipe 32 fell into an ash sink 34, or exited as exhaust through exhaust pipe 8, whose opening was above the ash sink 34. (Opening not shown) The ash sink 34 was emptied after the combustor was shut down. The exhaust pipe 8 extended up along the side of the combustion chamber and then diverged into two pipes 10 that vented to the outside. See FIG. 1. Splitting the exhaust between two pipes 10 decreased the exit velocity of the exhaust air. An optional pipe 23 may connect the inlet air to the single exhaust pipe 8, to help cool the exiting hot gases by mixing.

Figure 4:
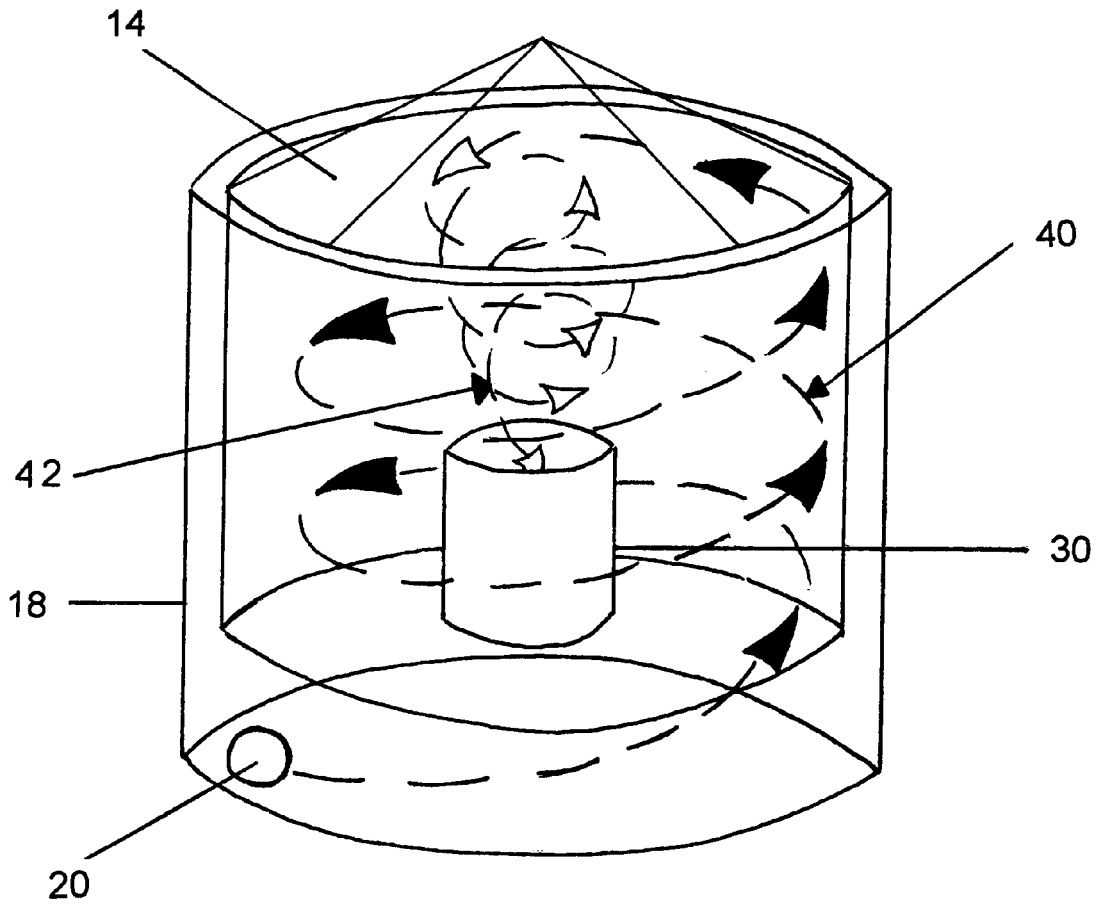
FIG. 4 illustrates a schematic view of one embodiment of the double vortex system.
Figure 5:
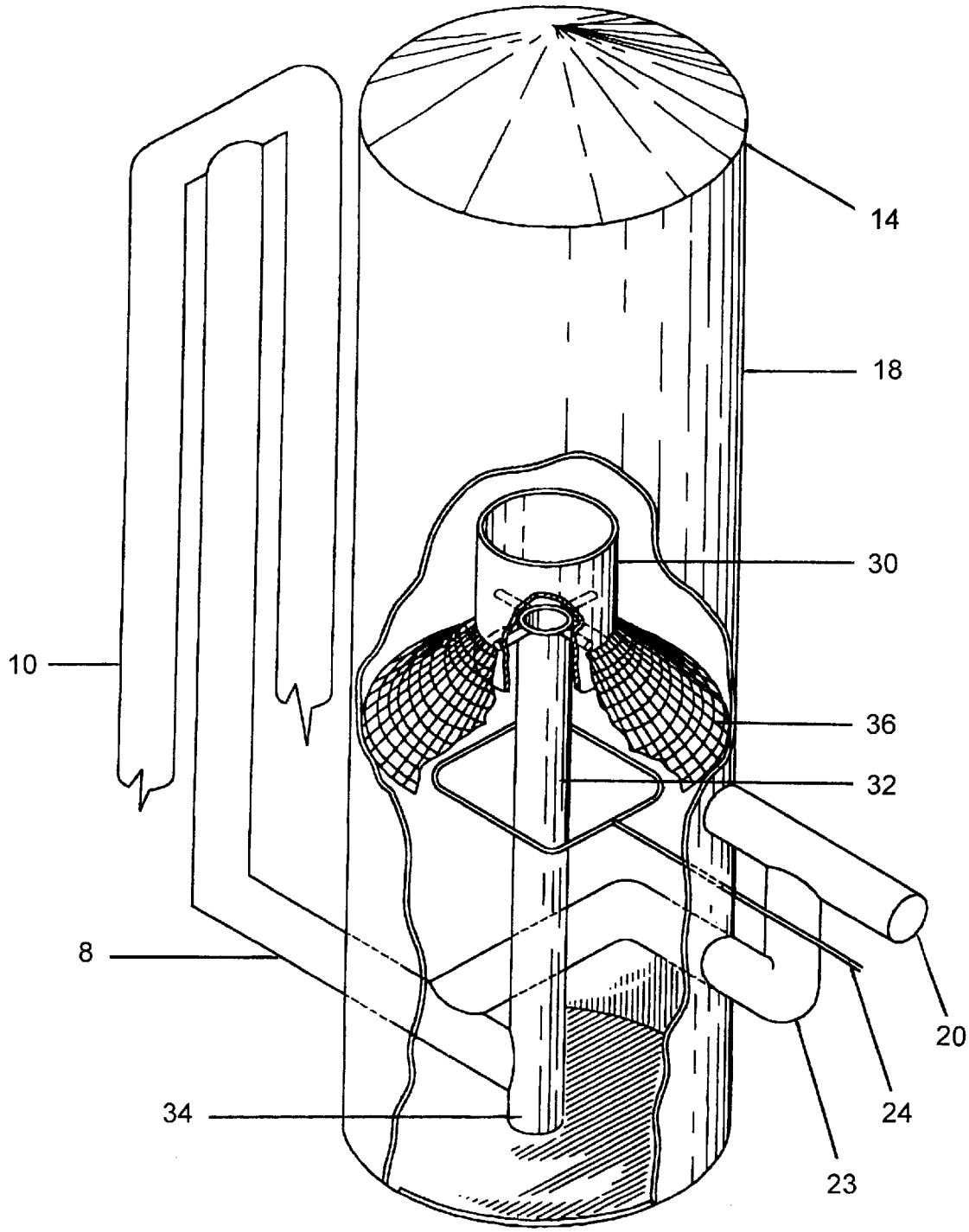
FIG. 5 illustrates a cutaway, perspective view of one embodiment of the combustor.

FIG. 4 illustrates a schematic view of one embodiment of the double vortex system. Air was tangentially injected into the combustion chamber 18 through the air inlet 20 and traveled in a counterclockwise (looking from the top of the combustor) ascending direction along the refractory material 28, forming ascending vortex 40. As the ascending vortex 40 reached the lid 14, it was reflected by the conical shape of lid 14 and formed a counterclockwise descending vortex 42. As the descending vortex 42 traveled towards the bottom of the combustion chamber 18, small combustion products entered a separator 30.

The components of the main section of the prototype are described more fully below.

EXAMPLE 1

Construction of the Prototype

The main section of the prototype combustor 26, the cylindrical combustion chamber 18, was made of a 61 cm diameter steel pipe lined with RESCOCAST® 3-20R refractory material (Resco Products Incorporated, Norristown, Pa.). The required thickness of the refractory material 28 was calculated to be 5 cm, using the methods of J. Marino, "Thermal Design of Refractory and Insulating Systems," Refractories and Insulation (1991), and using the assumptions of an operating temperature of approximately 815° C. (inside chamber) and 149° C. (outside the refractory material). The chamber 18 with the refractory material 28 had an internal diameter of 51 cm and a height of 1 m. A BK PRECISION® model TP-1 thermocouple (Electronix Express, Avenel, N.J.), designed for temperatures in the range of −40° C. to 900° C., was used to measure the temperature inside the combustion chamber 18. The thermocouple was placed between the inner wall and the lid 14 of the combustion chamber 18, the location of the highest temperatures. A digital readout of the temperature was produced by a BK PRECISION® Tool Kit multimeter (Electronix Express, Avenel, N.J.) attached to the thermocouple.

Air flow through the system was maintained by a Dayton Wet/Dry Vacuum blower (Shop-Vac Canada, Ltd., Burlington, Ontario) capable of producing a maximum flow rate of 0.06 $m^3/s$. An OMEGA® anemometer (Omega Engineering, Inc., Stamford, Conn.) was used to measure the velocity of the inlet air and the exhaust.

The chamber 18 was equipped with a propane burner assembly 24 made of 1.9 cm diameter pipe with holes drilled approximately 5.0 cm apart. The burner assembly 24 formed a rectangle in the bottom of the chamber 18, with the free end attached to an external propane gas tank.

One Sanming model S-75A loudspeaker (Sanming Electronics, Inc., China) was mounted externally by threading it onto a pipe extending from the inside of the chamber, generated acoustical vibrations to enhance mixing. A function generator was used to generate sinusoidal waves for an amplifier connected to the speaker. An LBO-507A Oscilloscope (Leader Electronic, Inc., Norcross, Ga.) was used to determine the amplitude and frequency of the sound waves.

The separator 30 was made of 15.24 cm diameter stainless steel pipe, with a length of 25.4 cm. The separator 30 acted as a cyclone divider.

The exit pipe 32 was made of 6.4 cm diameter stainless steel and was located in the center of the separator 30. The exit pipe 32 also provided support for the separator.

A stainless steel, conical shaped mesh screen 36 with a diameter of approximately 51 cm was located near the bottom of the combustion chamber 18, above the burner assembly 24.

In the initial test, dry wood chips were used as the combustible material. Calculations based on wood as the combustible material were made to estimate the airflow necessary to suspend the particles and provide efficient combustion. The calculations assumed an initial air velocity of 50 m/s and a combustion time of 200 seconds.

(1) Volume of Air Per Kilogram of Wood Required for Combustion ("Vol")

Stoichiometric combustion of wood=$C_6H_9O_4+6.25O_2 \rightarrow 6CO_2+4.5H_2O$

Molecular weight of wood ("$MW_w$")=145 kg/kmol

Molecular weight of oxygen ("$MW_o$")=32 kg/kmol

Density of oxygen in air at an outside temperature of 27° C. ("$\rho_o$")=1.29 $kg/m^3$ $$Vol=5.1\ m^3_{air}/kg_{wood}$$

(2) Flow Rate Required for Combustion ("$Q_1$")

$$Q_1=\text{Combustion time} \div Vol$$

$$Q_1=0.026\ m^3/s$$

(3) Velocity of Air Required to Suspend Material ("$V_1$"), Assuming a Given Mass and Diameter of Wood Mass of wood ("$m_w$")=0.001364 kg Viscosity of air ("$\mu_{air}$")=$449\times10^{-7}$ $Ns/m^2$ Density of wood ("$\rho_{wood}$")=414 $kg/m^3$ Density of air at an inside temperature of 827° C. ("$\rho_{air}$")=0.3166 $kg/m^3$ Diameter of wood chips ("$D_w$")=0.028 m Assumed velocity ("v")=50 m/s Reynold's number ("Re")=$(\rho_{air})(v)(D_w)\div\mu_{air}$ $$Re=9871.7$$

Drag Coefficicnt ("$C_D$")=0.7 (See R. Fox et al., *Introduction to Fluid Mechanics*, (John Wiley & Sons, 4th ed. 1992)).

Area of wood ("$A_w$")=$\pi(1/4)(D_w)^2$

Drag force ("$F_D$")=Weight=$0.5(C_D)(\rho_{air})(A_w)(V_1)^2$ $$V_1=14\ m/s$$

(4) Flow Rate Required for Suspension ("$Q_2$")

Effective area of the inner chamber ("$A_C$")=$\pi(1/4)(0.075)[(D_i)^2-(D_o)^2]$ Inner diameter of chamber ("$D_i$")=0.51 m Outer diameter of separator ("$D_o$")=0.1524 m $$Q_2=(A_C)(V_1)$$

$$Q_2=1.95\ m^3/s$$

From the above calculations, flow rate $Q_2$ was found to be the more stringent requirement for the blower fan because it was substantially larger than $Q_1$. After examining the results from the first experiment, it was concluded that a larger fan would produce better air flow, and that at least two more speakers would better enhance resonance for more efficient combustion.

EXAMPLE 2

Combustion Tests

To confirm that combustion was highly efficient, tests were conducted using wood chips in the prototype of Example 1, measuring interior chamber temperature and combustion rates.

To test for the formation of an ascending vortex by the blowing of air tangentially to the chamber, a test was run using a light white talcum with the lid open and the blower turned on. The movement of the white talcum confirmed the formation of an ascending vortex. Additionally, the initial steps of combustion were observed using wood chips with the lip open, the burner on, and the blower on. Suspension of the wood chips above the mesh and a formation of a flame vortex were confirmed.

Initial testing for potential temperature increases due to acoustical excitation of particles involved the total combustion of 1.82 kg of wood chips. During this combustion, each of three acoustical frequencies (10 Hz, 50 Hz, and 100 Hz) was tested for a period of five minutes. The results were compared to tests conducted with no acoustical excitation. It wag determined that none of the frequencies tested produced a measurable change in temperature. (Data not shown)

The second test involved measuring combustion rates at 10 Hz, 50 Hz, and 100 Hz. Time was measured from ignition of the wood chips to the time of effectively complete combustion, which was determined when the chamber 18 temperature dropped to 100° C. The results were compared to combustion rates with no acoustical excitation. Again, the results showed that no significant changes in combustion rates occurred due to a change in frequency. (Data not shown)

It is believed that the lack of any difference in either temperature change or combustion rate when using acoustical excitation was a result of the low vibrational energy produced by the speaker used in the experiments.

To test for complete combustion, an emission sample was analyzed using a mass spectrometer. A general survey of compounds was conducted for the sample. The emission sample produced relatively "clean" results in the mass spectrometer. Nitrogen, oxygen, and carbon dioxide were the main components present. (Data not shown)

From the above tests, several conclusions could be made. The burner 24 was effective in igniting the wood chips. A double vortex air flow was established and maintained inside the chamber 18 while combustion was taking place. The combustor 26 established a double vortex system comprising an ascending outer vortex 40 and a descending inner vortex 42 that deposited well-burned particles into a separator 30 near the center base of the combustion chamber 18. An air blower injected air tangentially through an inlet near the base at a mass flow rate sufficient to suspend the materials and create a flame vortex. The descending vortex 42 produced two beneficial outcomes. First, the shear between the ascending vortex 40 and descending vortex 42 increased particle mixing. Second, recirculation occurred when the descending vortex 42 entered the separator 30. Within the separator 30, the vortex acted as a cyclone separator, throwing denser particulates to the periphery of the separator 30. The particles were ejected back into the chamber 18 to be recirculated through the system for further combustion. The effluent stream, essentially devoid of particles, flowed into exit pipe 32 leading to the exhaust system. The heated exhaust escaped the chamber 18 via the exit pipe 32. The exhaust system led up the side of the chamber 18, branched off into two larger streams, and then proceeded back down to the ground. This arrangement reduced the velocity of the hot gases leaving the chamber 18.

The complete disclosures of all references cited in this specification are hereby incorporated by reference. Also incorporated by reference is the complete disclosure of the following papers: A. Bertges et al., "Acoustically Excited Vortex Incinerator for Biological Materials," (unpublished research project report) on file with the Louisiana State University Department of Biological Engineering (Apr. 30, 1997). In the event of an otherwise irreconcilable conflict, however, the present specification shall control.

We claim:

1. A method for combusting combustible materials, comprising the steps of:

(a) introducing the combustible materials into a vertical combustion chamber comprising a top; a bottom; a substantially cylindrical side wall connecting the top and bottom; a conical surface located inside the chamber below and near the top; a burner located inside the chamber, above and near the bottom; a conical mesh positioned above the burner; and at least one load bin mounted in the side wall; wherein the combustible materials are introduced into the chamber through the load bin onto the conical mesh; and wherein the chamber and the load bin are adapted to permit combustible material to be loaded into the chamber through the load bin while combustion in the chamber is ongoing;

(b) introducing fuel from an external fuel source to the burner, and igniting the fuel;

(c) generating a vortex by blowing air into the combustion chamber near the bottom, so that an ascending vortex is induced in hot gases leaving said burner, and so that the ascending vortex is converted by the conical surface to a descending vortex located centrally inside the ascending vortex; wherein the shear between the ascending and descending vortices enhances mixing of oxygen and uncombusted combustible materials; and (d) separating ash from gases in the descending vortex centrally near the bottom, and causing the separated gases to exit the chamber.

2. A method for combusting combustible materials as recited in claim 1, comprising two said load bins, wherein said load bins are mounted on opposite sides of said side wall.

3. A method for combusting combustible materials as recited in claim 1, wherein said mesh has a generally conical shape with a slope sufficient to allow material to fall to the outer edge of the mesh.

4. A method for combusting combustible materials as recited in claim 1, wherein said mesh has a generally conical shape with an opening at the apex making a tight fit with said separator.

5. A method for combusting combustible materials as recited in claim 1, additionally comprising a resonance generator acoustically coupled to said chamber.

6. A combustor for combusting combustible materials, comprising:

(a) a vertical combustion chamber comprising a top, a bottom, a substantially cylindrical side wall connecting said top and bottom, and at least one load bin mounted in said side wall; wherein said chamber and said load bin are adapted to permit combustible material to be loaded into said chamber through said load bin while combustion in said chamber is ongoing;

(b) a burner located inside said chamber, above and near said bottom, and adapted to receive fuel from an external fuel source;

(c) a vortex-generating assembly comprising an air blower located near the bottom of said combustion chamber, and positioned to induce an ascending vortex in hot gases leaving said burner; and a conical surface located inside said chamber below and near said top, wherein said conical surface has a slope adapted to convert the ascending vortex to a descending vortex located centrally inside the ascending vortex;

(d) a conical mesh positioned above the burner, adapted to support combustible material that is to be combusted, and that has not yet been suspended in one of the vortices;

(e) a separator centrally located near said bottom, adapted to separate ash from gases in the descending vortex; and (f) an exhaust pipe located centrally near said bottom, adapted to vent gases from the descending vortex.

7. A combustor as recited in claim 6, comprising two said load bins, wherein said load bins are mounted on opposite sides of said side wall.

8. A combustor as recited in claim 6, wherein said mesh has a generally conical shape with a slope sufficient to allow material to fall to the outer edge of the mesh.

9. A combustor as recited in claim 6, wherein said mesh has a generally conical shape with an opening at the apex making a tight fit with said separator.

10. A combustor as recited in claim 6, additionally comprising a resonance generator acoustically coupled to said chamber.

* * * * *